US005605465A

United States Patent [19]

Kobayashi et al.

[11] Patent Number: 5,605,465

[45] Date of Patent: Feb. 25, 1997

[54] BRANCH JOINT BOX

[75] Inventors: Makoto Kobayashi; Tsutomu Naitou, both of Yokkaichi, Japan

[73] Assignee: Sumitomo Wiring Systems, Ltd., Yokkaichi, Japan

[21] Appl. No.: 557,822

[22] Filed: Nov. 14, 1995

Related U.S. Application Data

[62] Division of Ser. No. 329,827, Oct. 27, 1994, Pat. No. 5,490,794.

[30] Foreign Application Priority Data

Nov. 5, 1993 [JP] Japan ..... 5-277066
Feb. 11, 1994 [JP] Japan ..... 6-20574

[51] Int. Cl.[6] ..... H01R 9/24

[52] U.S. Cl. ..... 439/76.2; 439/724

[58] Field of Search ..... 439/76.2, 212, 439/721–724, 885, 34

[56] References Cited

U.S. PATENT DOCUMENTS

| | | | |
|---|---|---|---|
| 4,954,090 | 9/1990 | Shimochi | 439/212 |
| 4,959,019 | 9/1990 | Shimochi | 439/76.2 |
| 5,011,417 | 4/1991 | Matsumoto et al. | 439/76.2 |
| 5,160,274 | 11/1992 | Ozaki et al. | 439/212 |
| 5,207,591 | 5/1993 | Ozaki et al. | 439/212 |
| 5,295,847 | 3/1994 | Ozaki et al. | 439/212 |
| 5,295,858 | 3/1994 | Kasai et al. | 439/404 |
| 5,403,193 | 4/1995 | Ito et al. | 439/34 |
| 5,417,589 | 5/1995 | Terada | 439/590 |

FOREIGN PATENT DOCUMENTS

| | | |
|---|---|---|
| 438120 | 7/1991 | European Pat. Off. . |
| 4131117 | 12/1992 | Japan . |

*Primary Examiner*—Gary F. Paumen
*Attorney, Agent, or Firm*—Greenblum & Berstein P.L.C.

[57] ABSTRACT

A branch joint box comprising: a base plate; and a pair of connector coupling portions which are, respectively, formed on opposite faces of the base plate so as to confront each other; the base plate being formed with a plurality of insertion openings for inserting therethrough bus bars each including an elongated base portion and at least one pair of tabs extending from opposite sides of the base portion, respectively; the insertion openings extending through the base plate so as to communicate the connector coupling portions with each other; wherein the bus bars are secured in the insertion openings, respectively such that the tabs project into the connector coupling portions, respectively.

4 Claims, 15 Drawing Sheets

BRANCH JOINT BOX

This application is a division of application Ser. No. 08/329,827, filed Oct. 27, 1994, now U.S. Pat. No. 5,490, 794 issued Feb. 13, 1996.

BACKGROUND OF THE INVENTION

The present invention generally relates to a bus bar blank, bus bars formed from the bus bar blank and a branch joint box including the bus bars and more particularly, to bus bars mounted in a branch joint box, in which bus bars of a plurality of patterns can be formed from one kind of a bus bar blank molded from an identical die and a branch joint box in which the bus bars of one pattern formed from the bus bar blank are mounted such that efficiency for assembling the branch joint box is raised.

Conventionally, a plurality of kinds of bus bars are accommodated in a branch joint box which is connected to intermediate portions of wiring harnesses for a motor vehicle. Shapes of these bus bars, i.e., bus bar patterns vary according to circuit configuration. When the bus bar patterns are different from each other, the bus bar blanks have hitherto been molded by different dies. Therefore, when there are a number of kinds of the bus bar patterns, a number of kinds of dies are also required to be prepared, thereby resulting in rise of production cost. When the bus bars are mounted on the branch joint box, the bus bars having different shapes are required to be attached to predetermined locations, respectively and thus, assembly of the branch joint box is troublesome.

Meanwhile, in the branch joint box, a branch joint point is concentrated at one spot so as to perform branch joint of wires reasonably and economically. In response to recent rise of density of wiring harnesses, branch joint boxes having various kinds of shapes are known.

For example, Japanese Utility Model Laid-Open Publication No. 4-131117 (1992) filed by the assignee assigned by the present inventors discloses a branch joint box shown in FIGS. 1 to 3. In this known branch joint box, a casing 73 is formed by upper and lower casings 71 and 72 which are formed with connection openings 71*a* and 72*a* for a connector X, respectively. A bus bar 74 is disposed between the upper and lower casings 71 and 72. The bus bar 74 includes an elongated base portion 74*a* and a plurality of pairs of tabs 74*b* arranged at a predetermined interval in a longitudinal direction of the base portion 74*a* and extending from opposite sides of the base portion 74*a* such that the tabs 74*b* project into the connection openings 71*a* and 72*a*.

The upper and lower casings 71 and 72 are of identical shape. On upper and lower faces of the casing 73, the connection openings 71*a* and 72*a* are formed symmetrically. Hence, in this known branch joint box, even if the connector X is connected to either one of the connection openings 71*a* and 72*a* of the upper and lower casings 71 and 72, an identical branch circuit is formed. As a result, the connector X can be connected to the known branch joint box without the need for paying attention to the upper and lower faces of the casing 73.

However, the known branch joint box referred to above is structurally complicated because the casing 73 is formed by two members, i.e., the upper and lower casings 71 and 72. Meanwhile, since the upper and lower casings 71 and 72 are molded by resin separately, resinous molding of the upper and lower casings 71 and 72 should be performed a total of two times, thereby resulting in rise of production cost.

Furthermore, in the known branch joint box, a case in which the upper and lower casings 71 and 72 have different shapes, respectively may happen. In this case, two kinds of dies are required to be prepared, thereby resulting in further rise of production cost due to increase of cost for the dies.

SUMMARY OF THE INVENTION

Accordingly, an essential object of the present invention is to provide, with a view to eliminating the drawbacks inherent in prior art, a bus bar blank molded by a single die, from which bus bars having a plurality of patterns can be formed by properly cutting the bus bar blank such that production cost of the bus bars is lowered and a branch joint box in which the bus bar of one pattern are mounted such that efficiency for assembling the branch joint box is raised.

Another important object of the present invention is to provide a branch joint box which is simplified in structure so as to be produced at low cost.

In order to accomplish the first object of the present invention, a bus bar blank formed by punching an electrically conductive metal plate, according to the present invention comprises: an elongated carrier; a plurality of pairs of opposite coupling portions which extend orthogonally from opposite sides of the carrier, respectively at a predetermined interval in a longitudinal direction of the carrier; a pair of opposite connecting portions which have a predetermined length and extend from a distal end of each of the pairs of the opposite coupling portions in parallel with the carrier; a pair of opposite first terminal portions which extend orthogonally from the opposite connecting portions, respectively; a pair of opposite second terminal portions which extend orthogonally from the opposite connecting portions, respectively such that the first and second terminal portions are disposed symmetrically with respect to a center of the coupling portions; and a pair of opposite third terminal portions which extend orthogonally from the opposite connecting portions, respectively at a location outside the first and second terminal portions and spaced a predetermined distance from one of the first and second terminal portions or at locations outside the first and second terminal portions and spaced the predetermined distance from the first and second terminal portions, respectively; wherein the bus bar blank includes a number of bus bar sets each including a pair of the opposite coupling portions, a pair of the opposite connecting portions and a pair of the opposite first, second and third terminal portions; wherein at a boundary of neighboring ones of the bus bar sets, a boundary one of the first, second and third terminal portions of one of the neighboring ones of the bus bar sets lies next to an opposed boundary one of the first, second and third terminal portions of the other of the neighboring ones of the bus bar sets and a necessary gap is formed between the boundary one and the opposed boundary one of the first, second and third terminal portions such that a bus bar is formed from one of the bus bar sets or a plurality of the bus bar sets by cutting the carrier; wherein by cutting off an unnecessary one of the first, second and third terminal portions from the bus bar, a bus bar of a different pattern can be formed.

Furthermore, the present invention provides a bus bar formed from the above mentioned bus bar blank, wherein the first and second terminal portions confront each other by bending the first and second terminal portions at the connecting portions through 90° and the third terminal portion extends in parallel with the first and/or second terminal portion at a predetermined distance therefrom.

Alternatively, the third terminal portion may be cut off from the bus bar.

Moreover, the present invention provides a branch joint box for accommodating the bus bars referred to above, comprising: a pair of connector coupling portions for receiving connectors, respectively, which are provided on opposed faces of the branch joint box, respectively; wherein a plurality of terminal holes are formed on each of the opposed faces at identical positions of the opposed faces such that the first, second and third terminal portions of the bus bars extend from the opposed faces through the terminal holes.

In order to enable the bus bars of an identical pattern to be used for the branch joint box, an interval of the terminal holes in a direction of a centerline of the branch joint box is set to a pitch between the first and second terminal portions of each of the bus bars and an interval of the terminal holes in a direction perpendicular to the centerline is set to a pitch between the first and third terminal portions of each of the bus bars.

Meanwhile, in case a plurality of the connector coupling portions are provided in parallel on each of the opposed faces of the branch joint box, an interval of the connector coupling portions is set to a distance between centers of neighboring ones of the connector coupling portions.

The casing of the branch joint box is formed by the upper and lower casings of an identical shape by overturning one of the upper and lower casings upside down. The coupling portions and the connecting portions of each bus bar are accommodated between the upper and lower casings and a pair of the terminal portions are, respectively, projected symmetrically from the terminal holes which are formed at the identical positions of the opposed faces in the connector coupling portions.

The bus bar blank of the present invention is formed by using a single die and each bus bar set constituted by a pair of the coupling portions, a pair of the connecting portions and a pair of the terminal portions extending continuously from the carrier is shaped so as to cope with a plurality of kinds of patterns for the bus bar. Therefore, by cutting off unnecessary portions from the bus bar set properly, bus bars of different patterns can be obtained from the bus bar blank formed by using the identical die. Furthermore, if the bus bar blank is cut into bus bars each corresponding to one bus bar set or a plurality of the bus bar sets as required, the bus bars can be used for the branch joint box in which the connector coupling portions are provided in parallel.

Moreover, the casing of the branch joint box is formed by the upper and lower casings of an identical shape by overturning one of the upper and lower casings upside down and the terminal holes are formed at the identical positions of the opposed faces of the branch joint box. Therefore, when the coupling portions and the connecting portions of each bus bar are disposed between the upper and lower casings and the terminal portions extending symmetrically from the opposite connecting portions are projected out of the terminal holes on the opposed faces of the branch joint box, the bus bars formed from the bus bar blank can be mounted on the branch joint box.

By the above described arrangement of the branch joint box, the opposed faces of the branch joint box have an identical circuit, so that directivity of the upper and lower faces of the branch joint box is eliminated, thereby resulting in rise of working efficiency at the time of use of the branch joint box.

Meanwhile, in order to accomplish the second object of the present invention, a branch joint box according to the present invention comprises: a base plate; and a pair of connector coupling portions which are, respectively, formed on opposite faces of the base plate so as to confront each other; the base plate being formed with a plurality of insertion openings for inserting therethrough bus bars each including an elongated base portion and at least one pair of tabs extending from opposite sides of the base portion, respectively; the insertion openings extending through the base plate so as to communicate the connector coupling portions with each other; wherein the bus bars are secured in the insertion openings, respectively such that the tabs project into the connector coupling portions, respectively.

In this branch joint box, since the insertion openings extend through the base plate so as to communicate with each other the connector coupling portions formed on the opposite faces of the base plate, the casing of the branch joint box is formed by a one-piece member.

Meanwhile, in the branch joint box, the bus bars may be gripped between a retainer plate retained in one of the connector coupling portions and partition wall portions of each insertion opening. Therefore, even if a force for drawing the bus bars towards either one of the connector coupling portions is applied to the bus bars, displacement of the bus bars is prevented by the retainer plate or the partition wall portions and thus, the bus bars are secured in the insertion openings.

Furthermore, in the branch joint box, the bus bars may be gripped between a pair of the retainer plates. Hence, even if a force for drawing the bus bars towards either one of the connector coupling portions is applied to the bus bars, displacement of the bus bars is regulated by the retainer plates and thus, the bus bars are secured in the insertion openings.

In addition, in the branch joint box, if a tab for press fitting each tab of each bus bar into each insertion opening is provided on each insertion opening, the bus bars are held in the insertion openings more positively.

BRIEF DESCRIPTION OF THE DRAWINGS

These objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
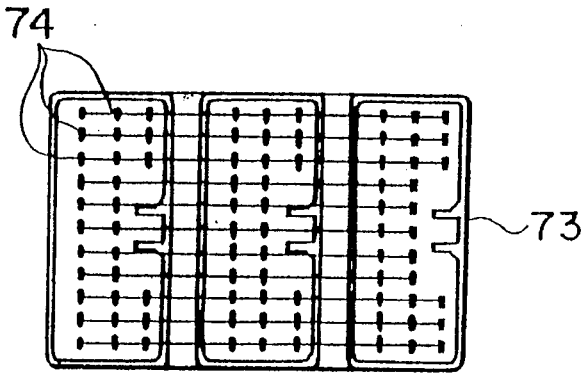
Fig. 1 PRIOR ART
FIG. 1 is a top plan view showing one example of a prior art branch joint box (already referred to)
Figure 2:
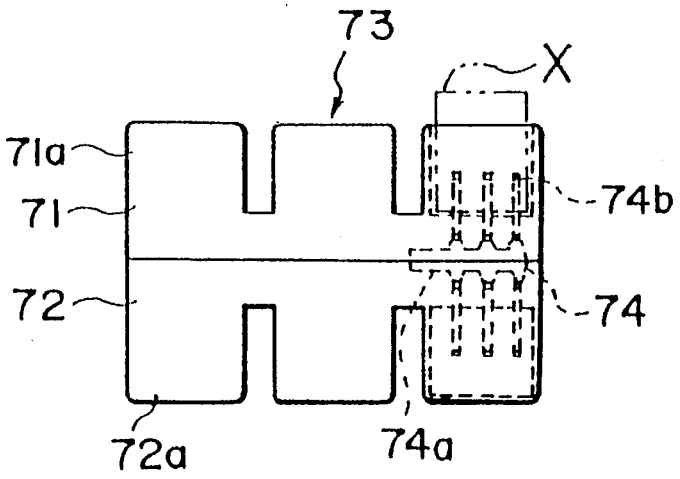
Fig. 2 PRIOR ART
FIGS. 2 and 3 are schematic sectional views of the prior art branch joint box of FIG. 1 (already referred to)
Figure 3:
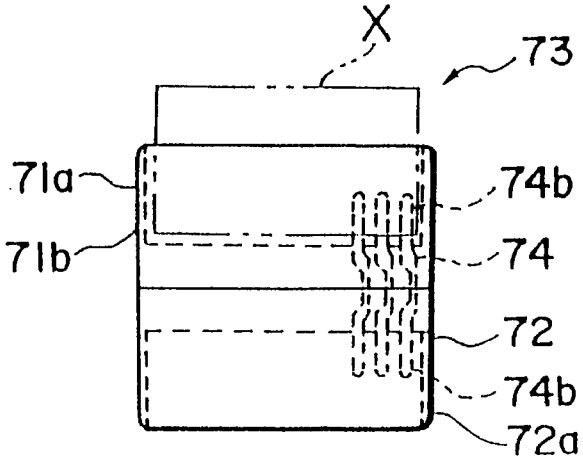
Fig. 3 PRIOR ART
Figure 4:
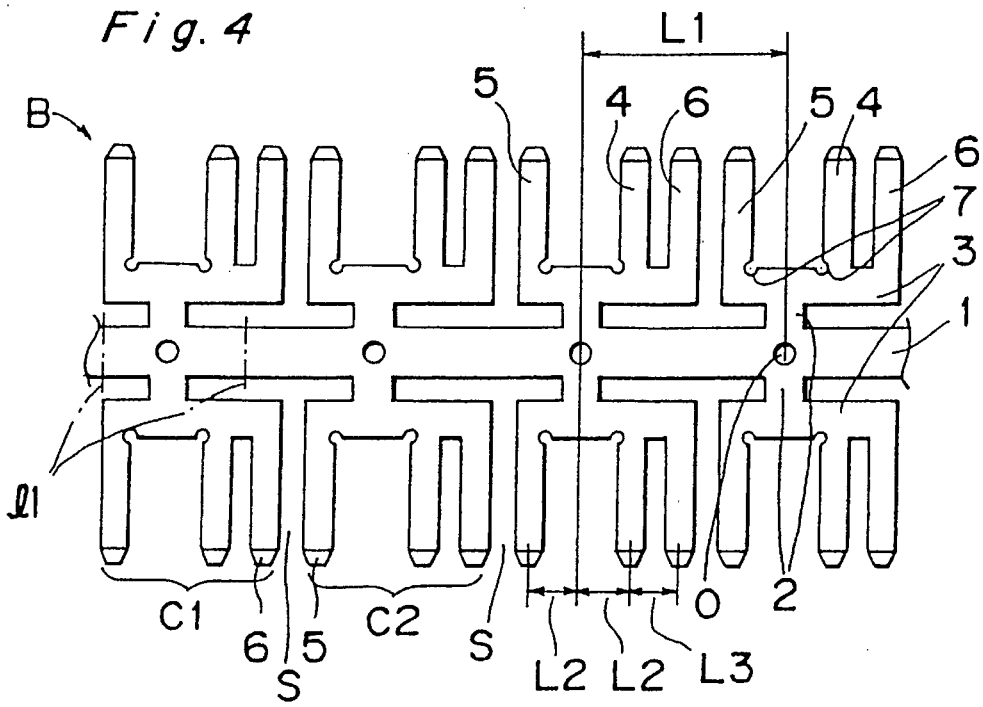
FIG. 4 is a top plan view of a bus bar blank of the present invention.

Referring now to the drawings, there is shown in FIG. 4, a bus bar blank B of the present invention. The bus bar blank B includes an elongated carrier 1 and a plurality of pairs of coupling portions 2 extending orthogonally from opposite sides of the carrier 1, respectively at a predetermined interval L1 in a longitudinal direction of the carrier 1. A connecting portion 3 having a predetermined length is provided at a distal end of each of the coupling portions 2 so as to extend in parallel with the carrier 1. A pair of first terminal portions 4 extend orthogonally from the opposite connecting portions 3, respectively, while a pair second terminal portions 5 extend orthogonally from the opposite connecting portions 3, respectively. The first and second terminal portions 4 and 5 interpose a center O of the coupling portion 2 therebetween so as to be spaced a distance L2 from the center O, respectively. Meanwhile, a pair of third terminal portions 6 extend orthogonally from the opposite connecting portions 3, respectively. The third terminal portion 6 is spaced a distance L3 from the first terminal portion 4 at one side of the first terminal portion 4 remote from the second terminal portion 5 such that the first terminal portion 4 is interposed between the second and third terminal portions 5 and 6. The first, second and third terminal portions 4, 5 and 6 have an identical shape in length and width. The third terminal portion 6 is disposed at one side of the first terminal portion 4 remote from the second terminal portion 5 as described above but may also be disposed at one side of the second terminal portion 5 remote from the first terminal portion 4.

At a base portion of each of the first and second terminal portions 4 and 5, a notch 7 for facilitating bending of the base portion of each of the first and second terminal portions 4 and 5 is formed on the connecting portion 3. A pair of the coupling portions 2, a pair of the connecting portions 3 and a pair of the first, second and third terminal portions 4, 5 and 6, which are formed as one bus bar set symmetrically with respect to the carrier 1, are successively arranged at the predetermined interval L1 in the longitudinal direction of the carrier 1. A gap S is defined between the second and third terminal portions 5 and 6 of two neighboring bus bar sets. Namely, as shown in FIG. 4, the gap S is defined between the third terminal portion 6 of a first bus bar set S1 and the second terminal portion 5 of a second bus bar set S2.

Figure 5:
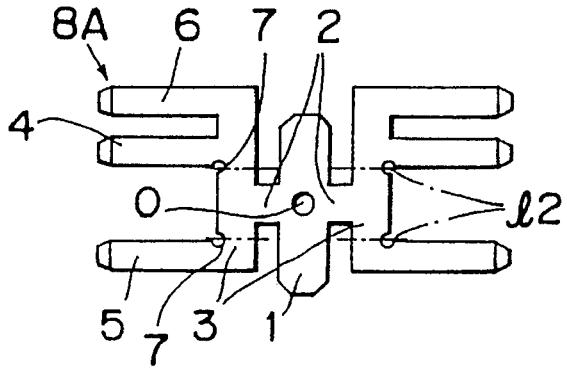
FIG. 5 is a top plan view of a bus bar member obtained by cutting the bus bar blank of FIG. 4.
Figure 6:
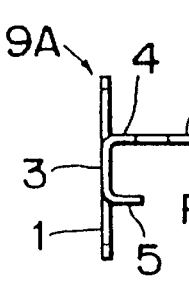
FIGS. 6, 7 and 8 are a left side elevational view, a top plan view and a right side elevational view of a bus bar formed from the bus bar member of FIG. 5, respectively.
Figure 7:
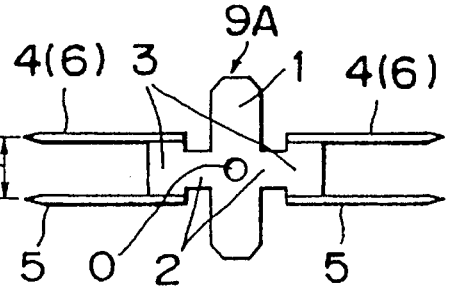
Figure 8:
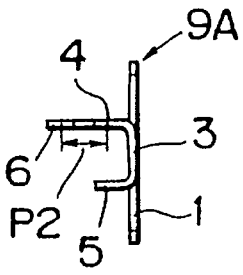
Figure 14:
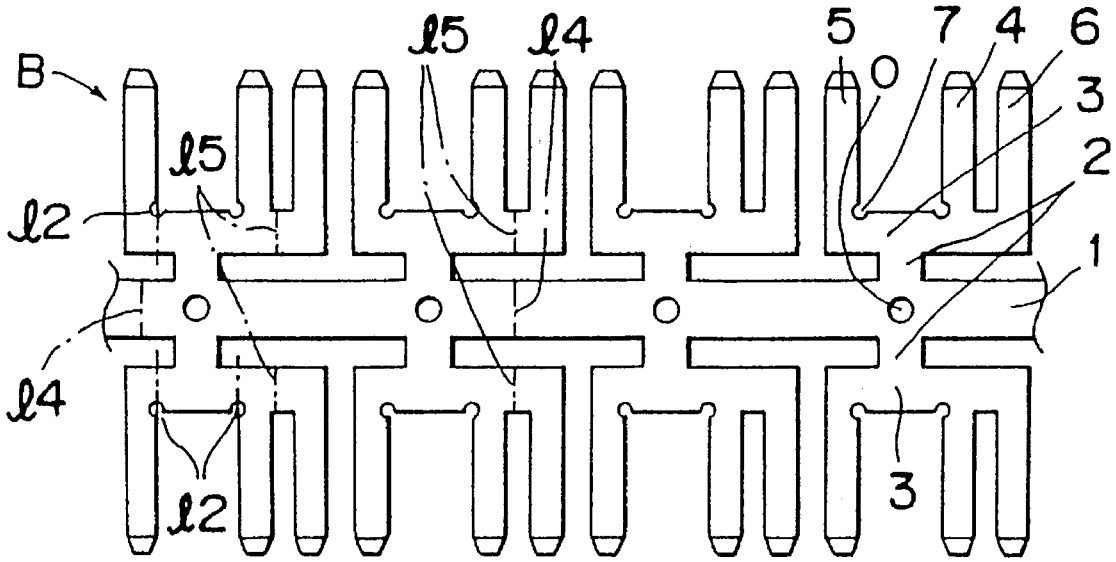
FIG. 14 is a top plan view of a bus bar blank having cutting portions different from those of FIG. 4.

According to constructions of a branch joint box 10 (FIG. 23) to which bus bars formed from the bus bar blank B are attached, one bus bar set can be separated from the bus bar blank B each time by cutting the carrier 1 as shown in FIG. 4 or a plurality of bus bar sets can be separated from the bus bar blank B each time by cutting the carrier 4 as shown in FIG. 14. In case one bus bar set is cut from the bus bar blank B each time, the carrier 1 is cut along cutting lines l1 in FIG. 4 and thus, a bus bar member 8A is obtained as shown in FIG. 5. Then, by using the notches 7 of the bus bar member 8A as starting points, the bus bar member 8A is bent through 90° in an identical direction along bending lines l2 in FIG. 5. As a result, a bus bar 9A in which the first and third terminal portions 4 and 6 extend in an identical plane and the first and second terminal portions 4 and 5 confront each other is obtained as shown in FIGS. 6 to 8. In FIGS. 6 to 8, "P1" denotes a pitch between the first and second terminal portions 4 and 5, while "P2" denotes a pitch (distance L3) between the first and third terminal portions 4 and 6 in a direction orthogonal to that of the pitch P1.

Figure 9:
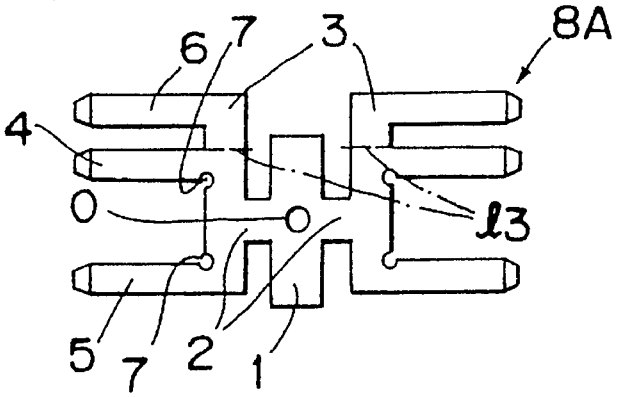
FIG. 9 is a top plan view of the bus bar member of FIG. 5 having cutting portions.
Figure 10:
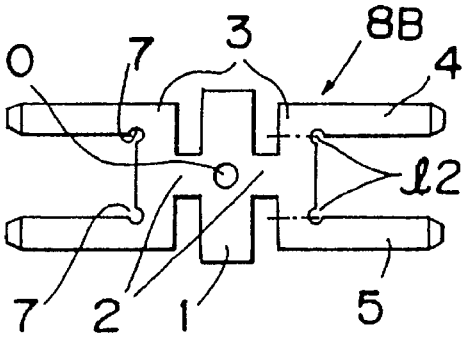
FIG. 10 is a top plan view of a bus bar member obtained by further cutting the, bus bar member of FIG. 9.
Figure 11:
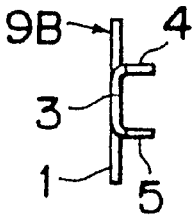
FIGS. 11, 12 and 13 are a left side elevational view, a top plan view and a right side elevational view of a bus bar formed from the bus bar member of FIG. 10, respectively.
Figure 12:
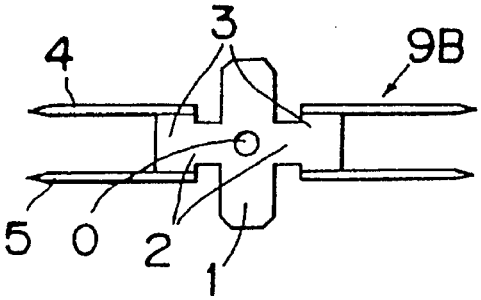
Figure 13:
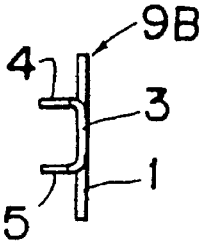

Meanwhile, when the bus bar member 8A obtained by cutting the carrier 1 of the bus bar blank B as shown in FIG. 4 is further cut along cutting lines l3 in FIG. 9 so as to cut off the third terminal portions 6 from the bus bar member 8A and thus, a bus bar member 8B is obtained as shown in FIG. 10. Then, when the bus bar member 8B is bent along bending lines l2 and thus, a bus bar 9B is obtained as shown in FIGS. 11 to 13. In the bus bar 9B, since the third terminal portions 6 are eliminated from the bus bar 9B, the first and second terminal portions 4 and 5 confront each other.

Figure 15:
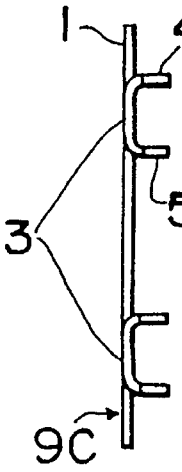
FIGS. 15, 16 and 17 are a left side elevational view, a top plan view and a right side elevational view of a bus bar formed from the bus bar blank of FIG. 14, respectively.
Figure 16:
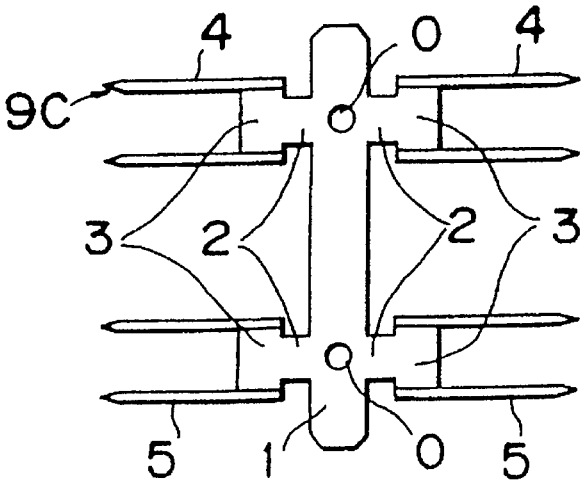
Figure 17:
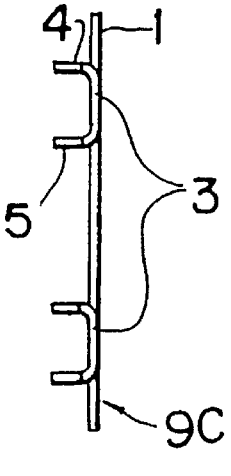

In case a plurality of bus bar sets are cut from the bus bar blank B each time, two bus bar sets are cut from the bus bar blank B each time by cutting the carrier 1 along cutting lines l4 as shown in FIG. 14. In addition, the connecting portions 3 are cut along cutting lines l5 so as to cut off the third terminal portions 6 from the connecting portions 3. Subsequently, the connecting portions 3 are bent through 90° along bending lines l2. As a result, a bus bar 9C is obtained as shown in FIGS. 15 to 17.

By cutting predetermined portions of the carrier 1 and the connecting portions 3 if necessary and by bending the bus bar blank B through 90° along the bending lines l2, bus bars 9 including the bus bars 9A, 9B, 9C, etc. of a plurality of patterns necessary for the branch joint box 10 for effecting branch joint of wiring harnesses can be formed from the bus bar blank B. Since the bus bars 9A, 9B, 9C, etc. of a plurality of patterns can be formed from the single bus bar blank B, the number of kinds of dies for molding the bus bar blanks can be reduced to one and thus, production cost of the bus bars can be lowered.

Figure 18:
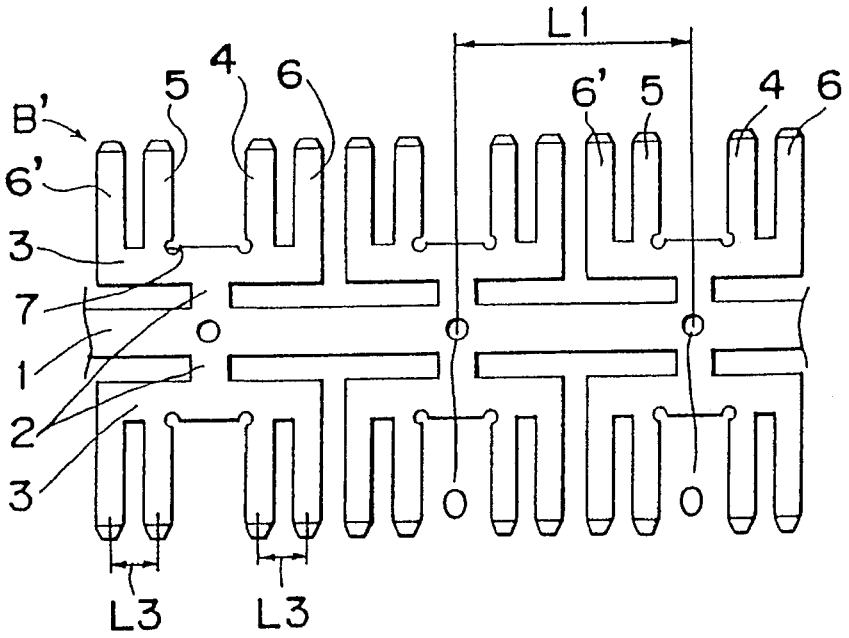
FIG. 18 is a view similar to FIG. 4, particularly showing its modification.
Figure 19:
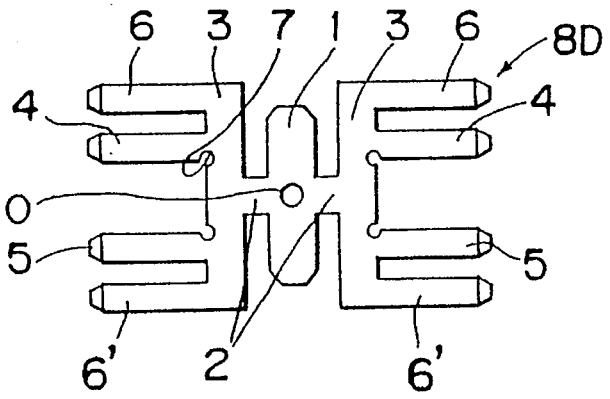
FIG. 19 is a top plan view of a bus bar member obtained from the bus bar blank of FIG. 18.
Figure 20:
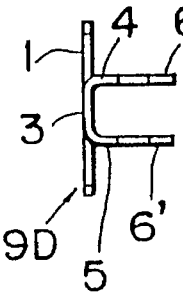
FIGS. 20, 21 and 22 are a left side elevational view, a top plan view and a right side elevational view of a bus bar formed from the bus bar member of FIG. 19, respectively.
Figure 21:
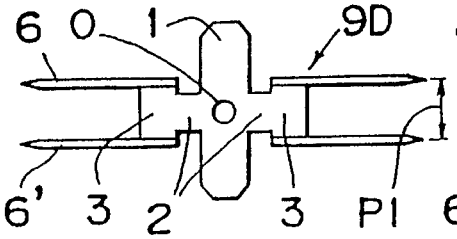
Figure 22:
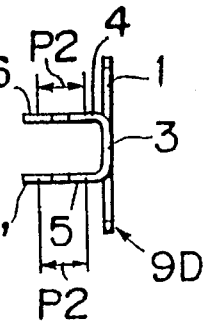

Meanwhile, the bus bar blank B is not restricted to the above described shape but may be modified as shown in FIG. 18. In a modified bus bar blank B' shown in FIG. 18, a further third terminal portion 6' is additionally provided at one side of the second terminal portion 5 remote from the first terminal portion 4 so as to be spaced the distance L3 from the second terminal portion 5. By cutting the bus bar blank B', a bus bar member 8D of one bus bar set, for example, is formed as shown in FIG. 19. Then, by bending the bus bar member 8D, a bus bar 9D is obtained as shown in FIGS. 20 to 22. In the bus bar 9D, a pitch between the third and further third terminal portions 6 and 6' is equal to the pitch P1 between the first and second terminal portions 4 and 5, while a pitch between the second and further third terminal portions 5 and 6' is equal to the pitch P2 between the first and third terminal portions 4 and 6. In the same manner as the bus bar blank B, the bus bars 9 of a plurality of patterns can be formed also from the bus bar blank B'.

Figure 23:
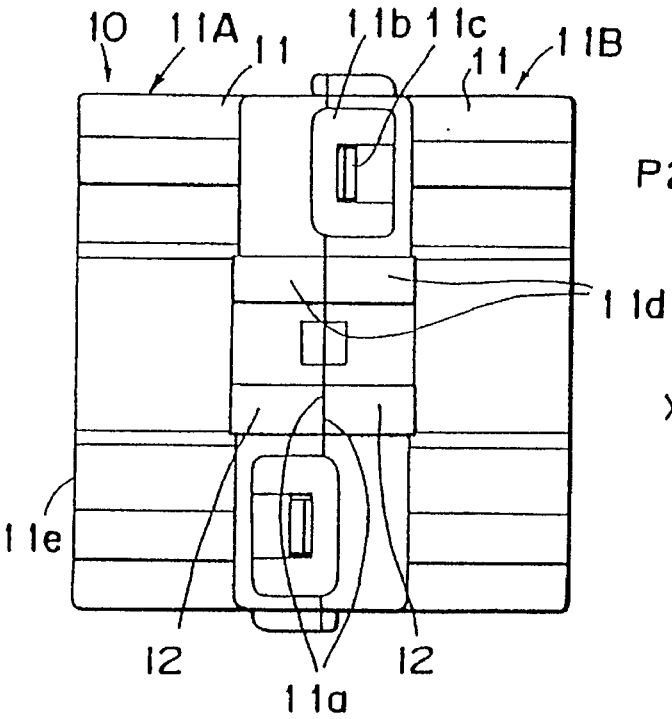
FIG. 23 is a top plan view of a branch joint box according to a first embodiment of the present invention.
Figure 24:
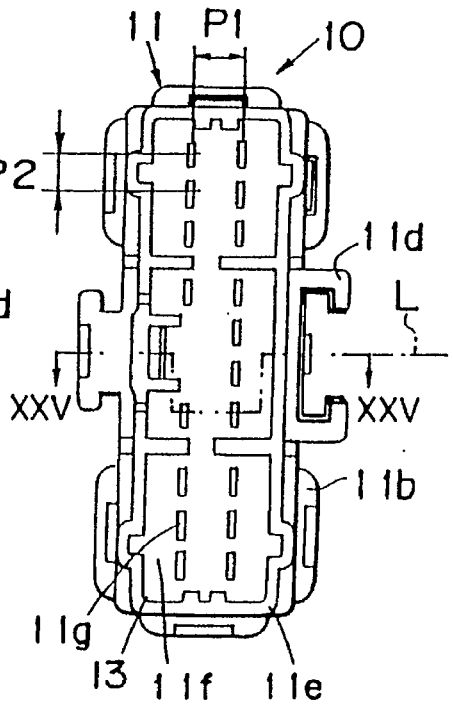
FIG. 24 is a front elevational view of the branch joint box of FIG. 23.

FIGS. 23 and 24 show a branch joint box 10 for accommodating the bus bars 9, according to a first embodiment of the present invention. A casing 11 of the branch joint box 10 is formed by upper and lower casings 11A and 11B of identical rectangular shape coupled with each other by overturning one of the upper and lower casings 11A and 11B upside down. A locking portion 11*b* and a mating locking portion 11*c* engageable with the locking portion 11*b* are provided on each of opposite outer side faces of the upper and lower casings 11A and 11B in the vicinity of one end face 11*a* of each of the upper and lower casings 11A and 11B. Each of the upper and lower casings 11A and 11B has a bracket 11*d* for securing the casing 11 to a mounting panel (not shown) of a motor vehicle.

Each of the upper and lower casings 11A and 11B has open opposite ends. At one end face 11*a*, the upper and lower casings 11A and 11B are coupled with each other and a bus bar mounting portion 12 in which the bus bars 9 are arranged is provided. At the other end face 11*e*, a connector coupling portion 13 for receiving a connector (not shown) so as to connect the connector to the bus bars 9 is provided. The bus bar mounting portion 12 and the connector coupling portion 13 are separated from each other by a partition wall 11*f*. The partition wall 11*f* acts as an end face of the connector coupling portion 13, on which two rows of terminal holes 11*g* for inserting therethrough the terminal portions 4, 5 and 6 of the bus bars 9 are formed as shown in FIG. 24 so as to be spaced a predetermined distance from each other. In FIG. 24, a lateral distance between the two rows of the terminal holes 11*g* is set to the pitch P1 between the first and second terminal portions 4 and 5 and a vertical distance between neighboring ones of the terminal holes 11*g* is set to the pitch P2 between the first and third terminal portions 4 and 6.

Figure 25:
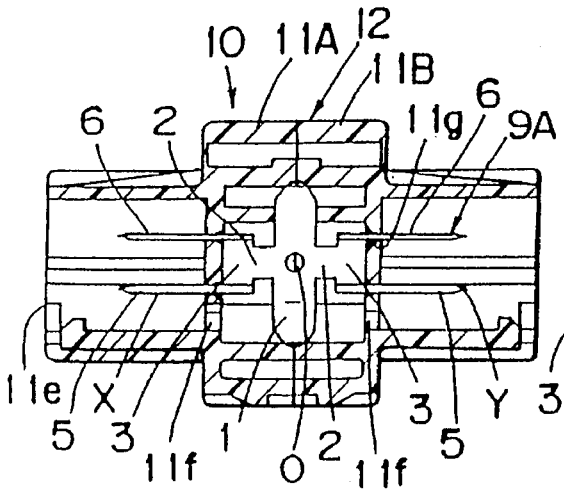
FIG. 25 is a sectional view taken along the line XXV—XXV in FIG. 24, in which the bus bars of FIG. 6 are accommodated in the branch joint box of FIG. 23.
Figure 26:
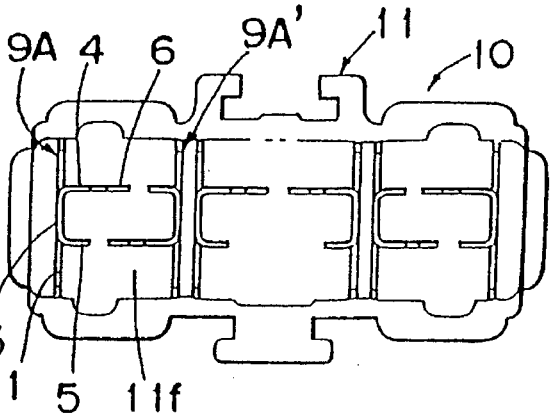
FIG. 26 is a front elevational view of the branch joint box of FIG. 25.

The bus bars 9 of an identical pattern formed from the bus bar blank B or B' are adapted to mounted on the branch joint box 10 of the above described arrangement. For example, the bus bars 9A shown in FIGS. 6 to 8 are accommodated in the branch joint box 10 as shown in FIGS. 25 and 26 so as to form a branch circuit. Meanwhile, it is needless to say that the bus bars of another pattern or the bus bars of a plurality of patterns may be used for the branch joint box 10. However, it is preferable that the bus bars of one pattern are used for the single branch joint box 10.

The bus bars 9 are mounted on the branch joint box 10 as follows. Initially, one bus bar 9A is disposed in the vicinity of the bus bar mounting portion 12 of the upper casing 11A and the first, second and third terminal portions 4, 5 and 6 located at one side X of the bus bar 9A are inserted through the terminal holes 11*g* of the upper casing 11A so as to be projected into the connector coupling portion 13 of the upper casing 11A. Subsequently, a bus bar 9A' identical with the bus bar 9A except for positions of the first, second and third terminal portions 4, 5 and 6 is provided such that the first and second terminal portions 4 and 5 of the bus bar 9A' confront the second and first terminal portions 5 and 4 of the bus bar 9A mounted already on the branch joint box 10, respectively. Thus, the first and second terminal portions 4 and 5 of the bus bar 9A' are inserted through the terminal holes 11*g*. By repeating such procedures, the first, second and third terminal portions 4, 5 and 6 of the bus bars 9 are inserted through all the terminal holes 11*g*.

Figure 27:
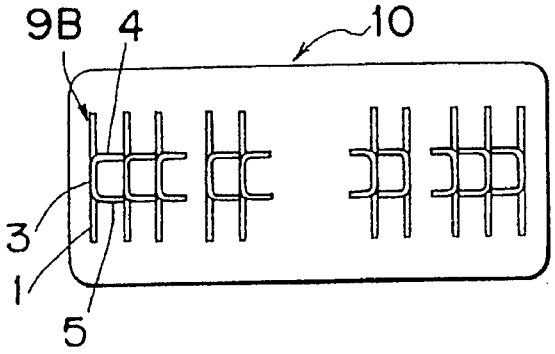
FIG. 27 is a schematic view showing arrangement of the bus bars of FIG. 11 in the branch joint box of FIG. 23.

Thereafter, the first, second and third terminal portions 4, 5 and 6 located at the other side Y of the bus bars 9A and projecting out of the bus bar mounting portion 12 of the upper casing 11A are inserted through the terminal holes 11*g* of the lower casing 11B so as to be protruded into the connector coupling portion 13 of the lower casing 11B. Finally, the locking portions 11*b* and the mating locking portions 11*c* of the lower casing 11B are, respectively, brought into engagement with the mating locking portions 11*c* and the locking portions 11*b* of the upper casing 11A such that the branch joint box 10 is assembled in a state where the carriers 1 of the bus bars 9A and 9A' are accommodated in the bus bar mounting portions 12. Connectors (not shown) are coupled with the connector coupling portions 13 disposed at opposite sides of the branch joint box 10, respectively. Meanwhile, the bus bars 9B shown in FIGS. 11 to 13 can be mounted on the branch joint box 10 as shown in FIG. 27.

As described above, in the branch joint box 10, a branch circuit can be formed by using the bus bars 9 of an identical pattern. Therefore, since additional time is not wasted for selecting the bus bars 9, efficiency for assembling the branch joint box 10 can be raised. Meanwhile, since the branch joint box 10 obtained by coupling the upper and lower casings 11A and 11B of an identical shape with each other, circuit patterns on the opposite faces of the branch joint box 10 can be made coincident with each other. Accordingly, directivity of the upper and lower faces of the branch joint box 10 can be eliminated, thus resulting in further rise of efficiency for assembling the branch joint box 10.

Figure 28:
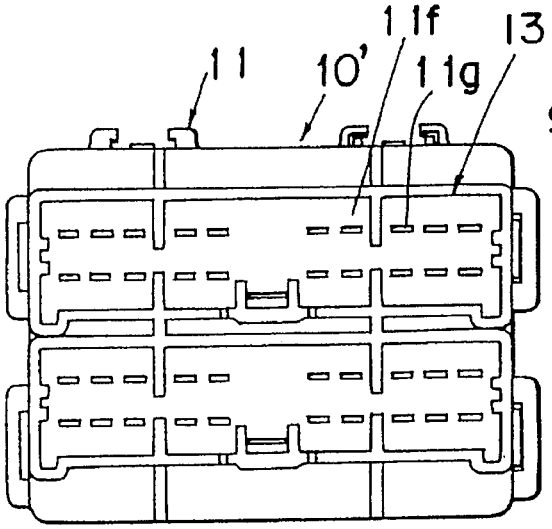
FIG. 28 is a front elevational view of a branch joint box which is a first modification of the branch joint box of FIG. 23.
Figure 29:
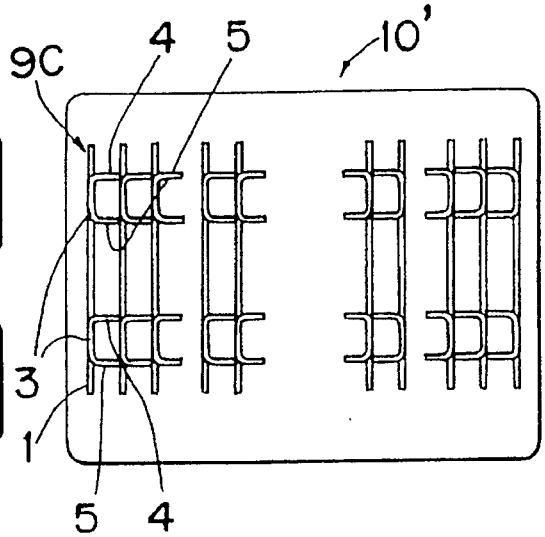
FIG. 29 is a front elevational view of the branch joint box of FIG. 28, in which the bus bars of FIG. 15 are accommodated.

Meanwhile, FIGS. 28 and 29 show a branch joint box 10' which is a first modification of the branch joint box 10. In the branch joint box 10', a plurality of, for example, two sets of the connector coupling portions 13 each having two rows of the terminal holes 11*g* are provided side by side such that a plurality of connectors (not shown) can be coupled with the branch joint box 10'. A distance between the two connector coupling portions 13 is set to the interval L1 between the centers O of neighboring ones of the coupling portions 2 of the bus bar blank B. In the branch joint box 10', a branch circuit can be formed by using the bus bars 9C each having two sets of the first and second terminal portions 4 and 5 at its one side as shown in FIG. 29.

Figure 30:
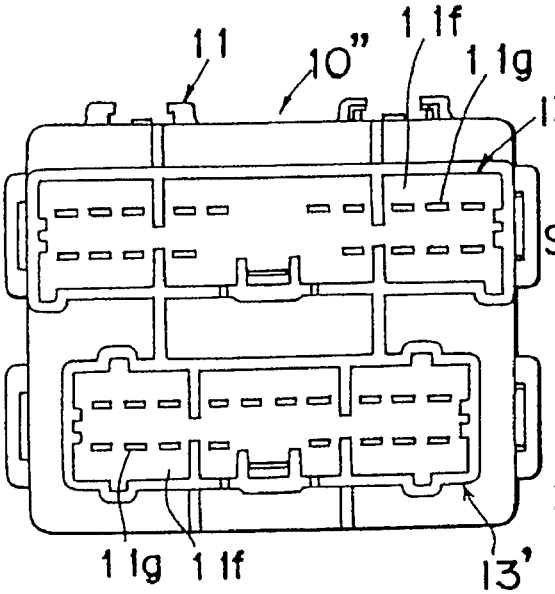
FIG. 30 is a front elevational view of a branch joint box which is a second modification of the branch joint box of FIG. 23.
Figure 31:
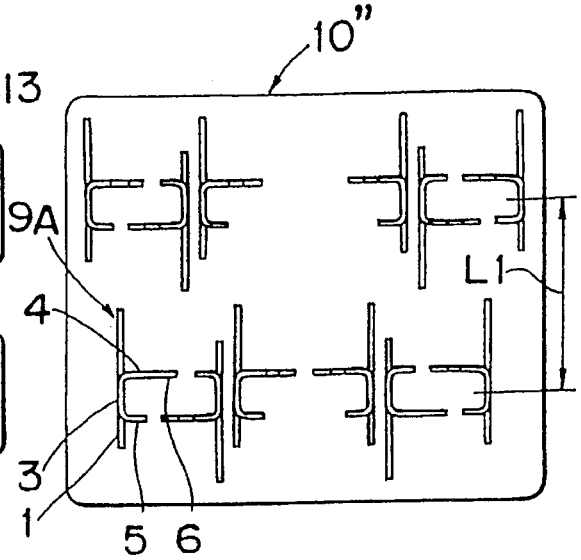
FIG. 31 is a front elevational view of the branch joint box of FIG. 30, in which the bus bars of FIG. 6 are accommodated.

FIGS. 30 and 31 show a branch joint box 10" which is a second modification of the branch joint box 10. Since two connectors having different outer shapes are coupled with the branch joint box 10", connector coupling portions 13 and 13' different in size from each other are juxtaposed in the branch joint box 10". As shown in FIGS. 31, a branch circuit can be formed in the branch joint box 10" by using, for example, the bus bars 9A shown in FIGS. 6 to 8.

As is clear from the foregoing of the bus bar blank of the present invention, a plurality of pairs of the coupling portions extend from the opposite sides of the carrier, respectively at the predetermined interval in the longitudinal direction of the carrier, while the first and second terminal portions are symmetrically projected from each of the coupling portions through the connecting portions. In addition, the third terminal portion is provided at an outside of the first or second terminal portion or at opposite sides of the first and second terminal portions. By cutting the carrier and the coupling portions at the predetermined positions and bending the base portions of the first and second terminal portions, the bus bars of a plurality of patterns can be formed. When the bus bars of a plurality of patterns are formed, the number of kinds of dies for molding the bus bar blanks can be reduced to one, thereby resulting in great reduction of production cost of the bus bar blank.

Meanwhile, in the branch joint box in which the bus bars formed from the above mentioned bus bar blank, since the distance between the two rows of the terminal holes for inserting the terminal portions therethrough is set to the pitch between the first and second terminal portions and the distance between neighboring ones of the terminal holes in each row of the terminal holes is set to the pitch between the first and third terminal portions, the two rows of the terminal holes are disposed symmetrically with respect to a centerline L (FIG. 24) of the branch joint box perpendicular to the rows of the terminal holes, a branch circuit can be formed by the bus bars of one pattern. Therefore, since additional time is not wasted for selecting the bus bars, efficiency for assembling the branch joint box can be raised.

Meanwhile, since the branch joint box is formed by the upper and lower casings of an identical shape such that the bus bars of one pattern can be mounted on the branch joint box, branch circuits formed on the opposite sides of the branch joint box are identical with each other. As a result, since directivity of the upper and lower faces of the branch joint box is eliminated, efficiency for assembling the branch joint box can be further raised.

Figure 41:
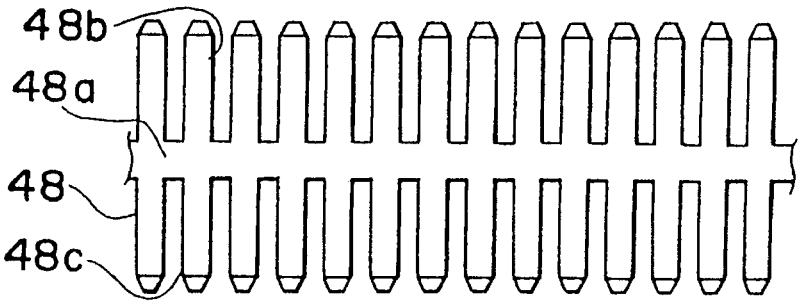
FIG. 41 is a front elevational view of a bus bar blank for obtaining bus bars for the branch joint box of FIG. 32.
Figure 42:
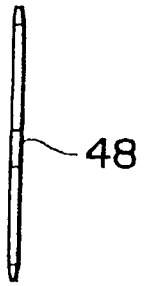
FIG. 42 is a side elevational view of the bus bar blank of FIG. 41.
Figure 43:
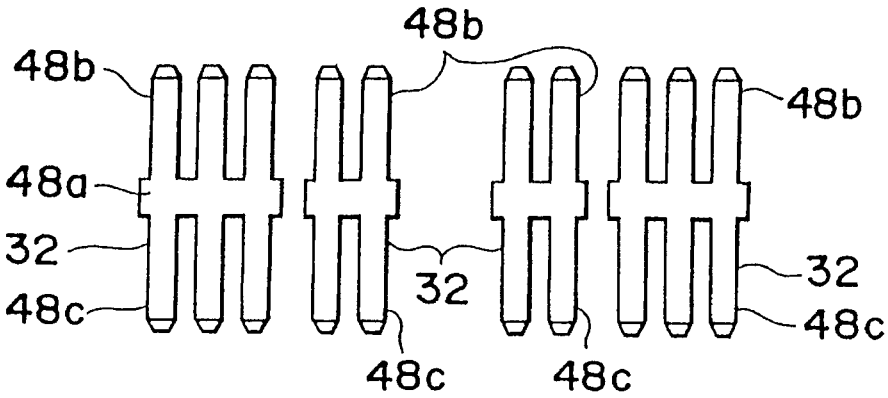
FIG. 43 is a front elevational view of the bus bars obtained from the bus bar blank of FIG. 41.

FIGS. 32 to 35 show a branch joint box 60 according to a second embodiment of the present invention. In the branch joint box 60, bus bars 32 shown in FIGS. 41 to 43 are accommodated in a resinous casing 31 shown in FIGS. 36 to 40 and are retained by first and second retainer plates 33 and 34 shown in FIGS. 44 and 45 and FIGS. 46 and 47, respectively. As shown in FIGS. 32 to 38, the casing 31 includes a rectangular thick base plate 36. Connector connecting portions 38A and 39A each having a tubular peripheral wall 37 are projected from an upper face 36*a* of the base plate 36, while connector coupling portions 38B and 39B each having the peripheral wall 37 are likewise projected from a lower face 36*b* of the base plate 36. The connector coupling portions 38A and 38B receive connectors X of an identical shape and are provided at symmetrical positions on the upper and lower faces 36*a* and 36*b* of the base plate 36, respectively so as to confront each other. Similarly, the connector coupling portions 39A and 39B receive connectors Y of an identical shape and are provided at symmetrical positions on the upper and lower faces 36*a* and 36*b* of the base plate 36, respectively so as to confront each other.

Figure 33:
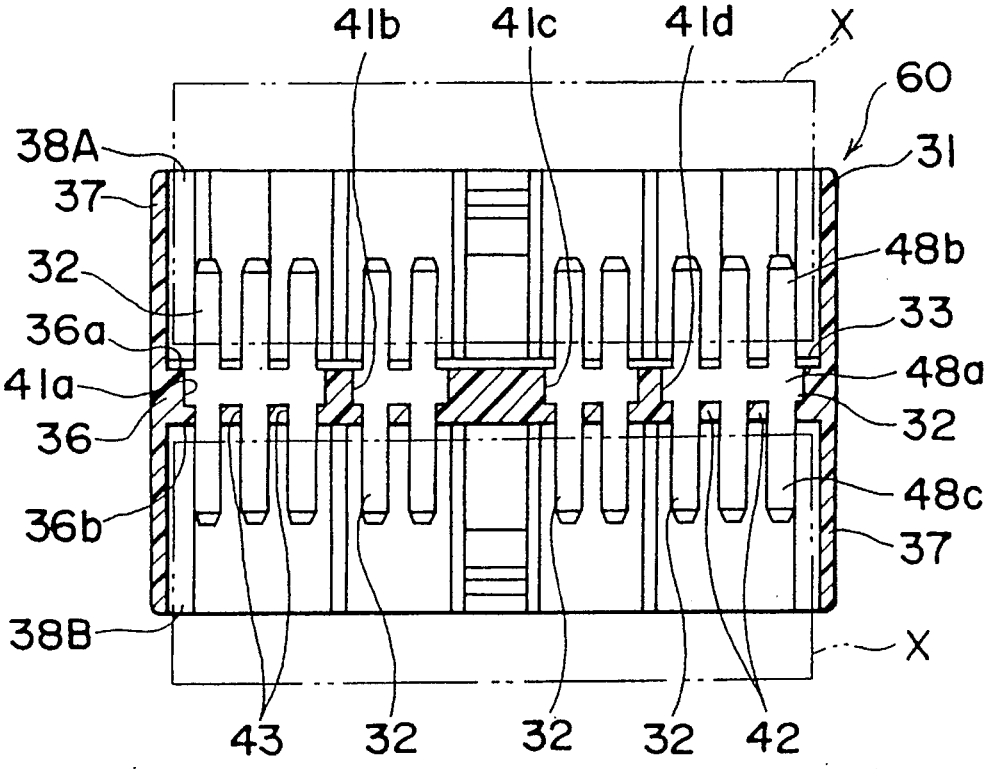
FIG. 33 is a sectional view taken along the line XXXIII—XXXIII in FIG. 32.
Figure 34:
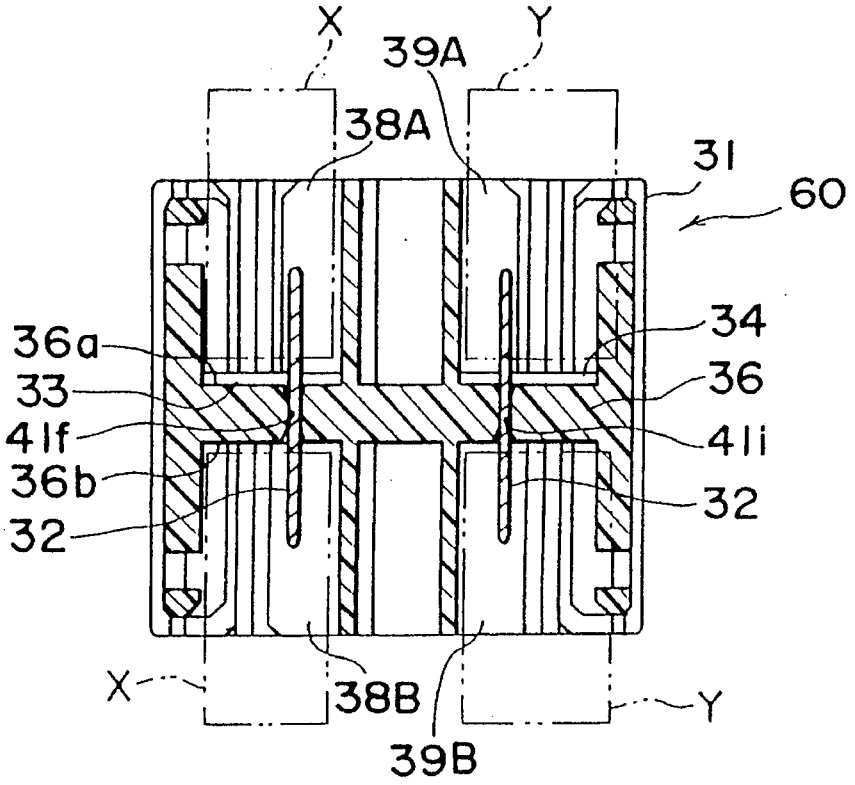
FIG. 34 is a sectional view taken along the line XXXIV—XXXIV in FIG. 32.
Figure 35:
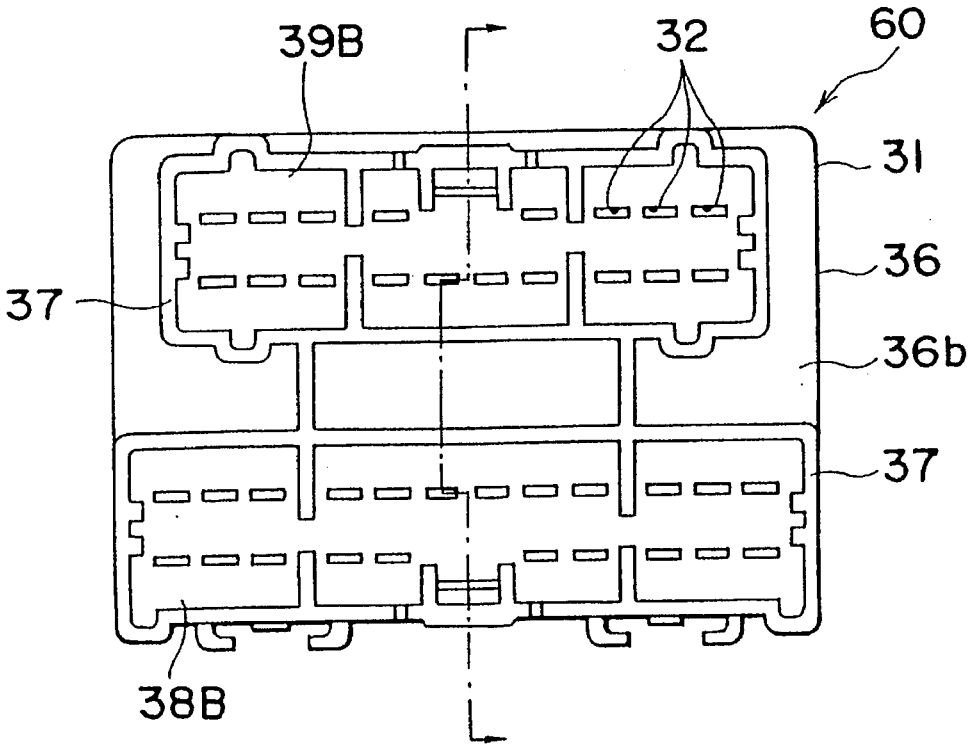
FIG. 35 is a bottom plan view of the branch joint box of FIG. 32.
Figure 36:
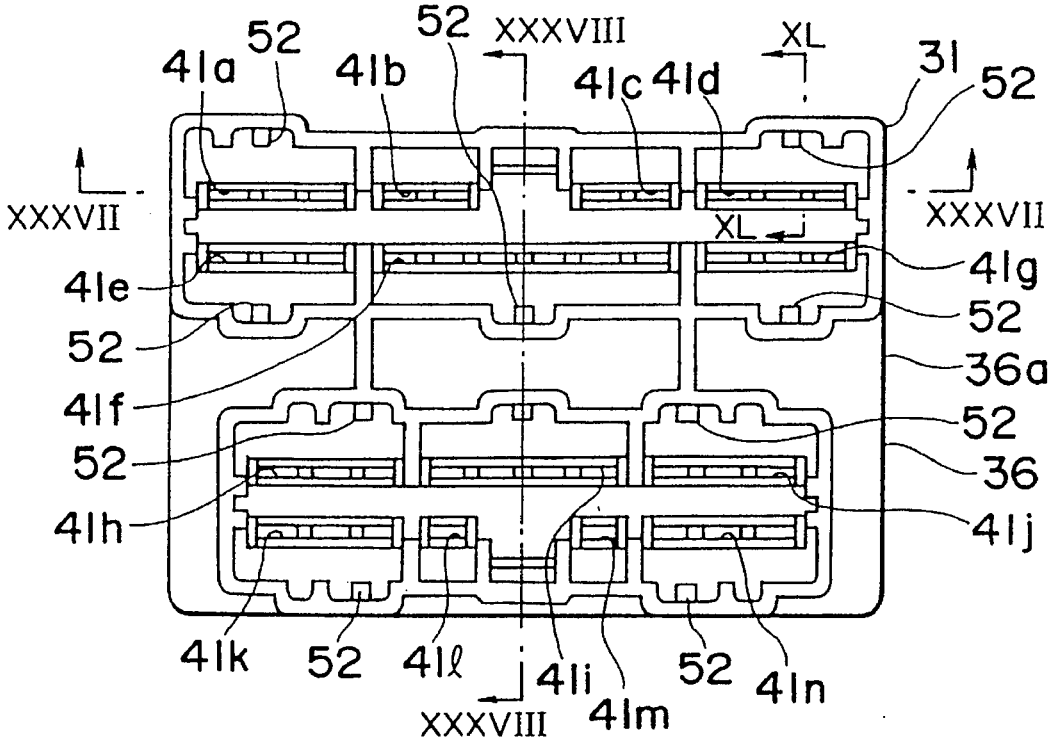
FIG. 36 is a top plan view of a casing of the branch joint box of FIG. 32.
Figure 37:
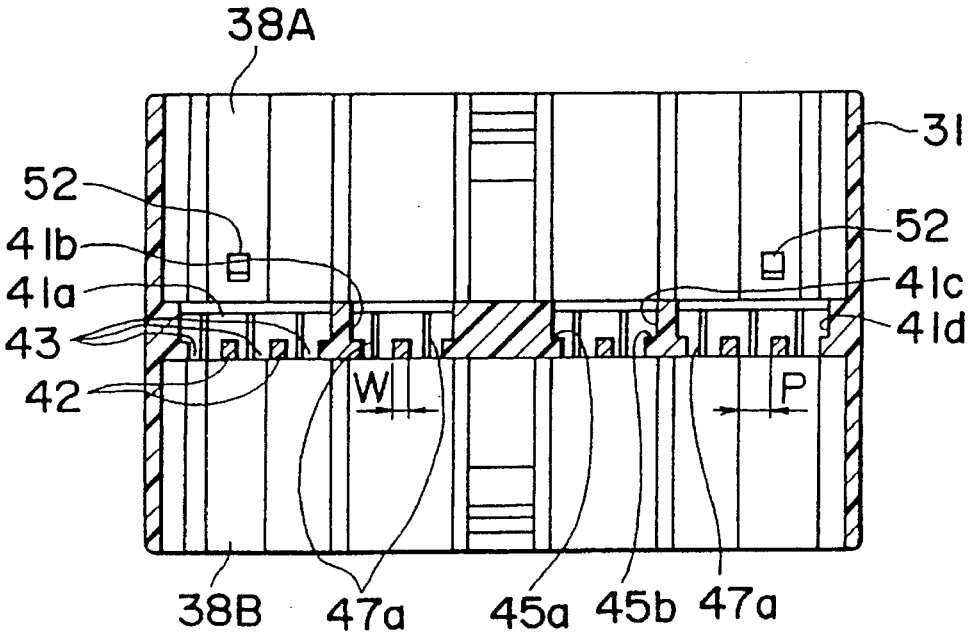
FIG. 37 is a sectional view taken along the line XXXVII—XXXVII in FIG. 36.
Figure 38:
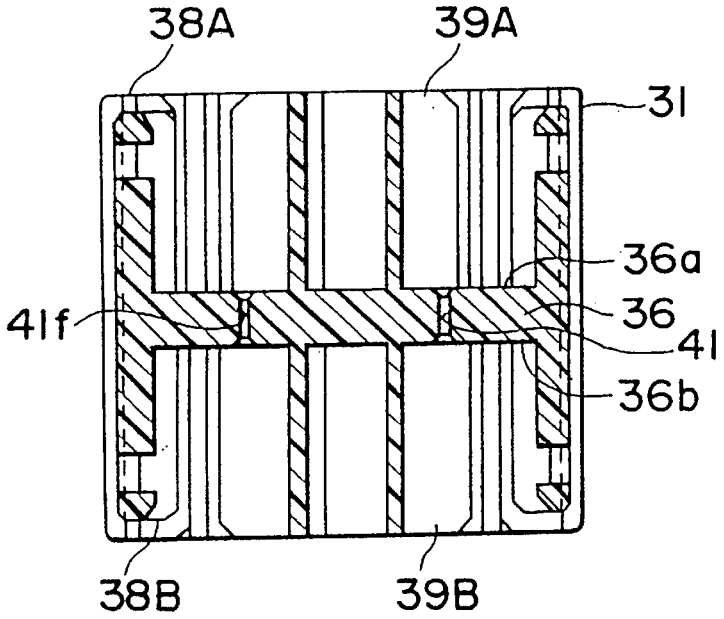
FIG. 38 is a sectional view taken along the line XXXVIII—XXXVIII in FIG. 36.

At the connector coupling portions 38A, 38B, 39A and 39B, insertion openings 41*a* to 41*n* each having a shape of an elongated slot are passed through the base plate 36 from the upper face 36*a* to the lower face 36*b* so as to communicate the connector coupling portions 38A and 39A with the connector coupling portions 38B and 39B, respectively. The bus bars 32 are inserted through the insertion openings 41*a* to 41*b* as shown in FIGS. 33 and 37. At the connector coupling portions 38A and 38B on the base plate 36, one row of the insertion openings 41*a* to 41*d* and another row of the insertion openings 41*e* to 41*g* are arranged in parallel with each other. Meanwhile, at the connector coupling portions 39A and 39B on the base plate 36, one row of the insertion openings 41*h* to 41*j* and another row of the insertion openings 41*k* to 41*n* are arranged in parallel with each other.

The insertion openings 41*a* to 41*n* except for the insertion openings 41*l* and 41*m*, namely, the insertion openings 41*a* to 41*k* and 41*n* have partition wall portions 42. A width W (FIG. 37) of each of the partition wall portions 42 is set to be substantially equal to an interval of tabs 48*b* and 48*c* of the bus bar 32. Meanwhile, an interval P between neighboring ones of the partition wall portions 42 is set to be substantially equal to a width of each of the tabs 48*b* and 48*c* of the bus bar 32. Each of the insertion openings 41*a* to 41*k* and 41*n* is divided by the partition wall portions 42 into two or three tab insertion holes 43 having an identical length and an identical width, through each of which each of the tabs 48*b* and 48*c* is inserted. Meanwhile, since only each of the tabs 48*b* and 48*c* is inserted through each of the insertion openings 41*l* and 41*m*, the partition wall portion 42 is not provided at the insertion openings 41*l* and 41*m*.

Figure 39:
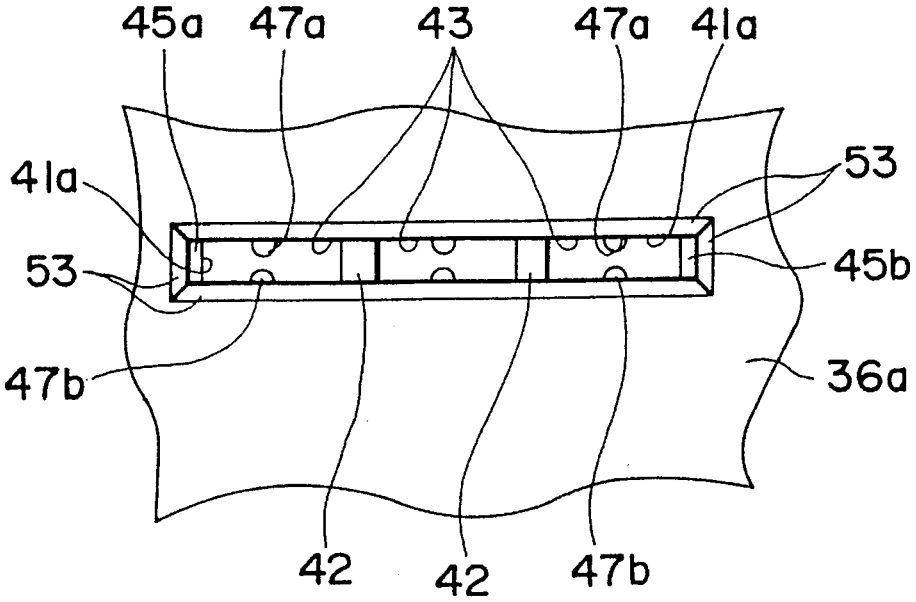
FIG. 39 is an enlarged view showing an insertion opening formed in the casing of FIG. 36.

Meanwhile, as shown in FIG. 37, at opposite ends of each of the insertion openings 41*a* to 41*n*, a peripheral wall of each of the insertion openings 41*a* to 41*n* is projected horizontally in the vicinity of the lower face 36*b* of the base plate 36 than in the vicinity of the upper face 36*a* of the base plate 36 so as to form support steps 45*a* and 45*b*. Furthermore, as shown in FIGS. 37 and 39, ribs 47*a* and 47*b* for press fitting are, respectively, provided on opposite side peripheral walls of the tab insertion hole 43 so as to confront each other. Each of the ribs 47*a* and 47*b* has a semicircular cross-sectional shape and extends in a direction of thickness of the base plate 36.

The bus bars 32 are obtained by cutting a bus bar blank 48 (FIGS. 41 and 42) at predetermined intervals. This bus bar blank 48 includes an elongated base portion 48*a* and a plurality of pairs of the rectangular tabs 48*b* and 48*c* projecting from opposite sides of the base portion 48*a*, respectively at a predetermined interval in a longitudinal direction of the base portion 48*a*. The tabs 48*b* and 48*c* are arranged to have an identical width. By cutting the base portion 48*a* of the bus bar blank 48 as shown in FIG. 43, the bus bars 32 are formed such that the number of the tabs 48*b* or 48*c* is equal to that of the tab insertion holes 43 of the insertion openings 41*a* to 41*n*.

In the tabs 48*b* and 48*c* projecting from the opposite sides of the base portion 48*a* of the bus bars 32, respectively, the tabs 48*c* are inserted into the tab insertion holes 43 of the insertion openings 41*a* to 41*n*. Since the ribs 47*a* and 47*b* for press fitting are provided in each tab insertion hole 43, the tab 48*c* is press fitted in between the ribs 47*a* and 47*b*. Meanwhile, the bus bar 32 is inserted into each of the insertion openings 21*a* to 21*n* such that not only opposite ends of the base portion 48*a* of the bus bar 32 are supported by the support steps 45*a* and 45*b*, respectively but the base portion 48*a* is held in contact with the partition wall portions 42.

Figure 32:
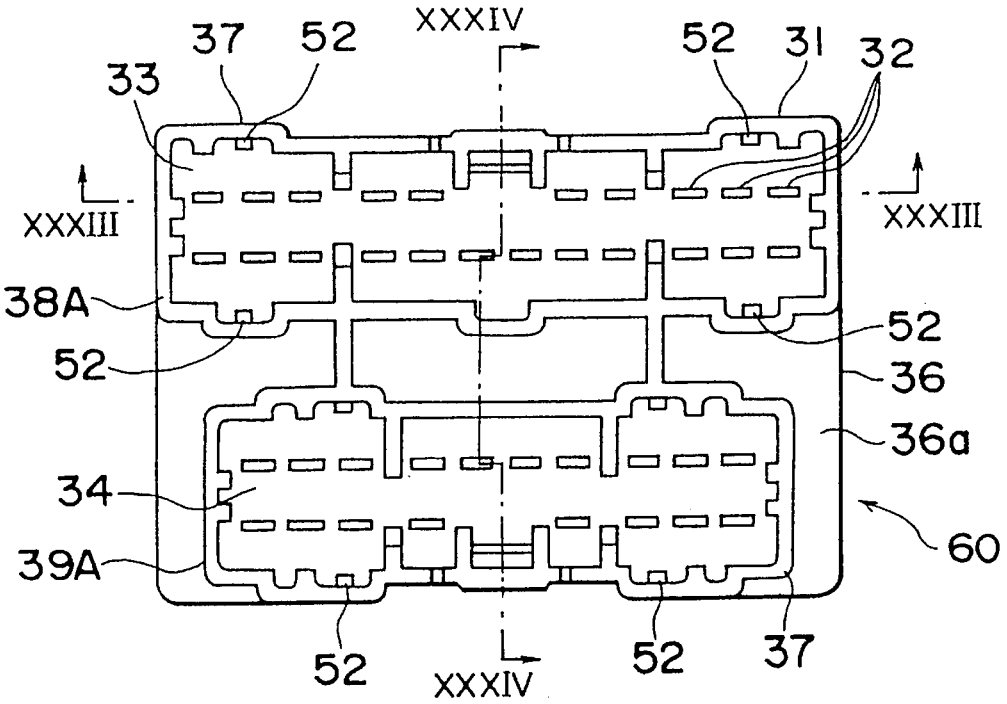
FIG. 32 is a top plan view of a branch joint box according to a second embodiment of the present invention.
Figure 44:
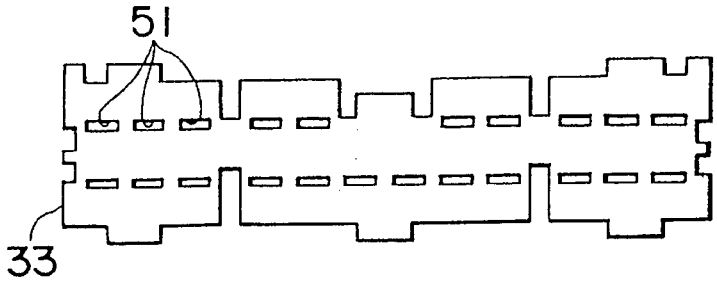
FIG. 44 is a front elevational view of a first retainer plate employed in the branch joint box of FIG. 32.
Figure 45:
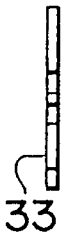
FIG. 45 is a side elevational view of the first retainer plate of FIG. 44.
Figure 46:
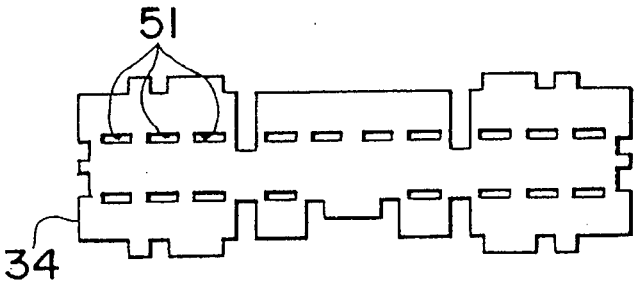
FIG. 46 is a front elevational view of a second retainer plate employed in the branch joint box of FIG. 32.
Figure 47:
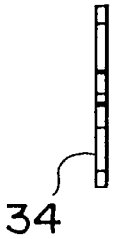
FIG. 47 is a side elevational view of the second retainer plate of FIG. 46.

On the upper face 36*a* of the base plate 36, first and second retainer plates 33 and 34 for holding the bus bars 32 in the insertion openings 41*a* to 41*n* are, respectively, provided at the connector coupling portions 38A and 39A as shown in FIG. 32. As shown in FIGS. 44 and 45, outer peripheral shape of the first retainer plate 33 is substantially identical with inner periphery of the peripheral wall 37 of the connector coupling portion 38A. Likewise, as shown in FIGS. 46 and 47, outer peripheral shape of the second retainer plate 34 is substantially identical with inner periphery of the peripheral wall 37 of the connector coupling portion 39A. Meanwhile, at positions corresponding to the tab insertion holes 43 of the insertion openings 41*a* to 41*n*, through-holes 51 extending in a direction of thickness of the first and second retainer plates 33 and 34 are formed on the first and second retainer plates 33 and 34.

The first and second retainer plates 33 and 34 are, respectively, inserted into the connector coupling portions 38A and 39A in parallel with the base plate 36. When the tabs 48*b* of the bus bars 32 inserted into the insertion openings 41*a* to 41*n* have been inserted through the through-holes 51 of the first and second retainer plates 33 and 34, the first and second retainer plates 33 and 34 are retained by bosses 52 provided on inner periphery of the peripheral wall 37 of each of the connector coupling portions 38A and 39A.

Figure 40:
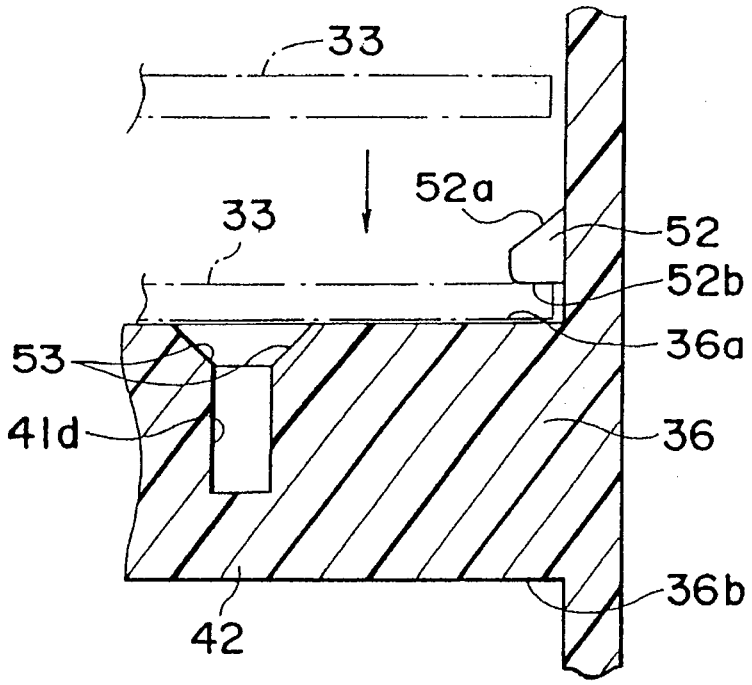
FIG. 40 is an enlarged sectional view taken along the line XL—XL in FIG. 36.

As shown in detail in FIG. 40, the boss 52 has an upper inclined surface 52*a* and a lower engagement surface 52*b* parallel to the base plate 36. A distance between the engagement surface 52*b* and the upper face 36*a* of the base plate 36 is set to be substantially equal to thickness of the first and second retainer plates 33 and 34. Thus, the first and second retainer plates 33 and 34 inserted into the connector coupling portions 38A and 39A ride over the bosses 52 so as to be retained between the bosses 52 and the base plate 36. Meanwhile, as shown in FIGS. 39 and 40, each of the insertion openings 41*a* to 41*n* is formed, at the upper face 36*a* of the base plate 36, with an oblique guide surface 53 for guiding a distal end of the tabs 48*c* when the bus bars 32 are inserted into the insertion openings 41*a* to 41*n*.

The branch joint box 60 of the above described arrangement is assembled as follows. Initially, the bus bars 32 are placed in the connector coupling portions 38A and 39A on the upper face 36*a* of the base plate 36 and are inserted into the tab insertion holes 41*a* to 41*n* such that the tabs 48*c* of the bus bar 32 are inserted into the tab insertion holes 43, respectively. Then, the first and second retainer plates 33 and 34 are inserted into the connector coupling portions 38A and 39A such that the tabs 48*b* of the bus bars 32 are passed through the through-holes 51 of the first and second retainer plates 33 and 34. By further depressing the first and second retainer plates 33 and 34 towards the base plate 36, the first and second retainer plates 33 and 34 are caused to ride over the bosses 52 so as to be retained between the base plate 36 and the engagement surface 52*b* of each of the bosses 52. Therefore, in FIG. 33, upper displacement of the bus bars 32 is restricted by the first and second retainer plates 33 and 34, while lower displacement of the bus bars 32 is regulated by the partition wall portions 42. As a result, the bus bars 32 are secured in the insertion openings 41*a* to 41*n*.

In the branch joint box 60, since the insertion openings 41*a* to 41*n* are provided on the opposite faces of the base plate 36 of the casing 31, the branch joint box 60 is simplified in structure as compared with an arrangement in which the casing is formed by upper and lower casings. Meanwhile, since the casing 31 is formed by a one-piece member, the number of dies for molding the casing can be reduced to one and the casing can be obtained by performing resinous molding only once, production cost of the casing can be lowered.

Meanwhile, in the branch joint box 60, the tabs 48*c* projecting from one side of the base portion 48*a* of each of the bus bars 32 retained in the insertion openings 41*a* to 41*n* extend into the connector coupling portions 38B and 39B through the tab insertion holes 43, while the tabs 48*b* projecting from the other side of the base portion 48*a* of each of the bus bars 32 are projected into the connector coupling portions 38A and 39A through the through-holes 51 of the first and second retainer plates 33 and 34. In addition, in the bus bar 32, width of the tabs 48*b* and pitch between neighboring ones of the tabs 48*b* are set to be equal to those of the tabs 48*c*. Therefore, even if a connector is connected to either the connector coupling portions 38A and 39A provided at one side of the casing 31 or the connector coupling portions 38B and 39B provided at the other side of the casing 31, an identical branch circuit is formed. Accordingly, the connector can be connected to the branch joint box 60 without the need for paying attention to the upper and lower faces of the casing 31.

Furthermore, in the branch joint box 60, the tabs 48*c* projecting from one side of the base portion 48*a* of each of the bus bars 32 are, respectively, inserted into the tab insertion holes 43. Meanwhile, the tabs 48*b* projecting from the other side of the base portion 48*a* of each of the bus bars 32 are passed through the through-holes 51 of the first and second retainer plates 33 and 34 and the first and second retainer plates 33 and 34 are retained in the connector coupling portions 38A and 39A such that the bus bars 32 are gripped between the first and second retainer plates 33 and 34 and the partition wall portions 42. Therefore, even if an upward force for drawing the bus bars 32 out of the connector coupling portions 38A and 39A is applied to the bus bars 32, upward displacement of the bus bars 32 is restricted by the first and second retainer plates 33 and 34. On the other hand, even if a downward force for drawing the bus bars 32 out of the connector coupling portions 38B and 39B is applied to the bus bars 32, downward displacement of the bus bars 32 is restrained by the partition wall portions 42. Accordingly, the bus bars 32 are held in the insertion openings 41*a* to 41*n* positively. In addition, since the tabs 48*b* and 48*c* are inserted through the tab insertion holes 43 or the through-holes 51, it is possible to prevent deformation of the tabs 48*b* and 48*c*.

Figure 48:
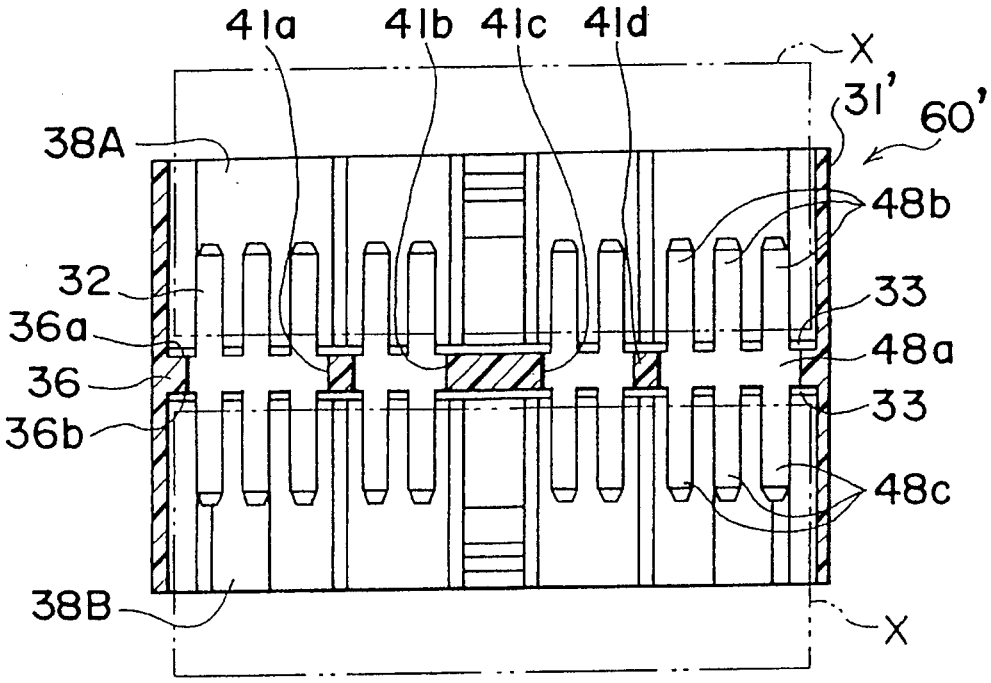
FIG. 48 is a sectional view of a branch joint box which is a modification of the branch joint box of FIG. 32.
Figure 49:
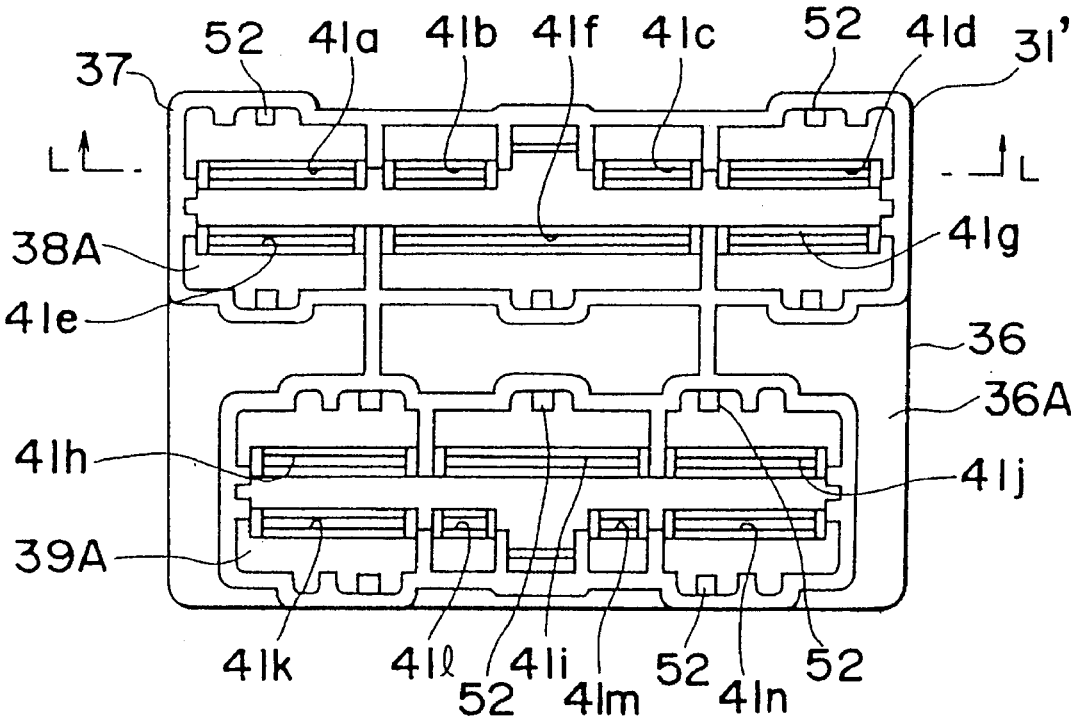
FIG. 49 is a top plan view of a casing of the branch joint box of FIG. 48.
Figure 50:
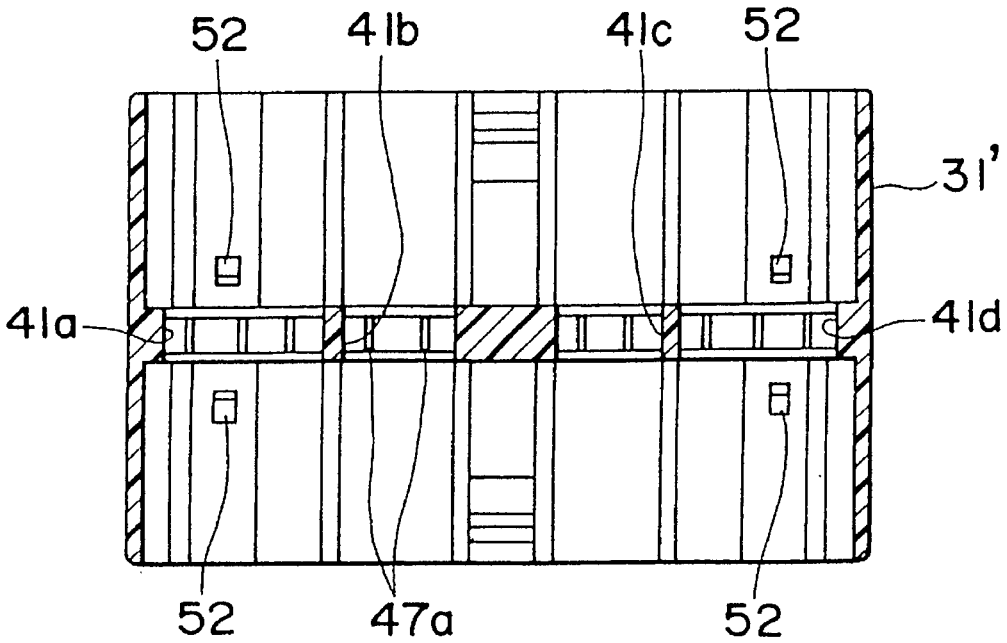
FIG. 50 is a sectional view taken along the line L—L in FIG. 49.

FIGS. 48 to 50 show a branch joint box 60' which is a modification of the branch joint box 60. The branch joint box 60' includes a casing 31'. In the branch joint box 60', the partition wall portions 42 of the branch joint box 60 are not provided at the insertion openings 41*a* to 41*n* such that the bus bars 32 are fixed by the first and second retainer plates 33 and 34 provided on both the upper and lower faces 36*a* and 36*b* of the base plate 36.

In each of the opposite connector coupling portions 38A and 38B, the first retainer plate 33 is retained by the bosses 52 in a state where the tabs 48*b* and 48*c* are inserted through the through-holes 51. Similarly, in each of the opposite connector coupling portions 39A and 39B, the second retainer plate 34 is retained by the bosses 52 in a state where the tabs 48*b* and 48*c* are inserted through the through-holes 51. Hence, the bus bars 32 are gripped between a pair of the first retainer plates 33 and between a pair of the second retainer plates 34 so as to be secured in the insertion openings 41*a* to 41*n*.

In the branch joint box 60', even if an upward force for drawing the bus bars 32 out of the connector coupling portions 38A and 39A is applied to the bus bars 32, upward displacement of the bus bars 32 is regulated by the first and second retainer plates 33 and 34 retained in the connector coupling portions 38A and 39A. Meanwhile, even if a downward force for drawing the bus bars 32 out of the connector coupling portions 38B and 39B is applied to the bus bars 32, downward displacement of the bus bars 32 is restricted by the first and second retainer plates 33 and 34 retained in the connector coupling portions 38B and 39B.

Since the casing 31' of the branch joint box 60' is also formed by a one-piece member, the casing 31' is simplified in structure and can be obtained by performing resinous molding with a single die only once, thereby resulting in reduction of production cost.

Meanwhile, since the tabs 48*b* and 48*c* of the bus bars 32, which have an identical width and an identical pitch, are projected into the opposite connector coupling portions 38A and 38B and the opposite connector coupling portions 39A and 39B, the connector can be connected to the branch joint box 60' regardless of the upper and lower faces of the casing 31'. Since other constructions of the branch joint box 60' are similar to those of the branch joint box 60, their description is abbreviated for the sake of brevity.

Figure 51:
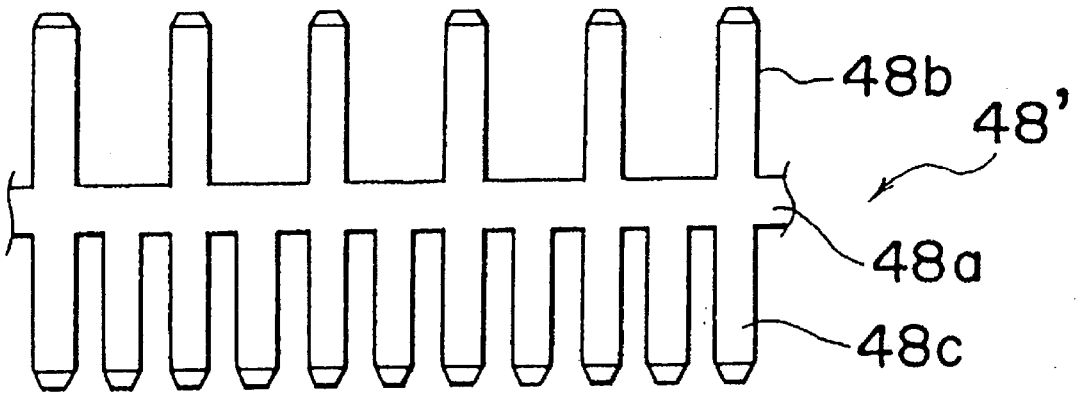
FIG. 51 is a view similar to FIG. 41, particularly showing its first modification.
Figure 52:
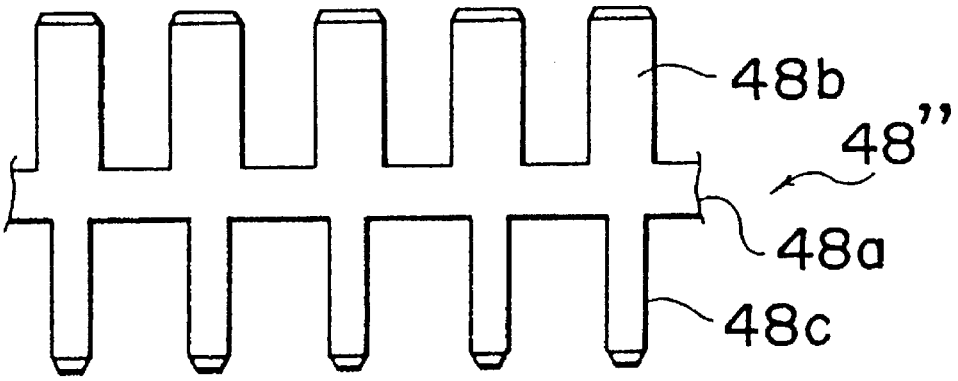
FIG. 52 is a view similar to FIG. 41, particularly showing its second modification.

The branch joint boxes 60 and 60' can be modified variously. For example, in the bus bar blank 48 of FIG. 41, the tabs 48*b* and 48*c* having an equal width extend from opposite sides of the elongated base portion 48*a* at an identical interval. However, the bus bar blank 48 may be replaced by a bus bar blank 48' (FIG. 51) or 48" (FIG. 52). In the bus bar blank 48' of FIG. 51, pitch of the tabs 48*b* disposed at one side of the base portion 48*a* is made different from that of the tabs 48*c* disposed at the other side of the base portion 48*a*. In case the bus bar blank 48' is used for the branch joint box 60, width of the partition wall portions 41*a* to 41*n* and interval of the through-holes 51 of the first and second retainer plates 33 and 34 may be set in conformity with the pitches of the tabs 48*b* and 48*c*. Meanwhile, in case the bus bar blank 48' is used for the branch joint box 60', interval of the through-holes 51 of the first and second retainer plates 33 and 34 may be set in conformity with the pitches of the tabs 48*b* and 48*c*.

Meanwhile, in the bus bar blank 48" of FIG. 52, width of the tabs 48*b* disposed at one side of the base portion 48*a* is made different from that of the tabs 48*c* disposed at the other side of the base portion 48*a*. Also in this case, length of the tab insertion holes 43 and the through-holes 51 of the first and second retainer plates 33 and 34 may be set in conformity with the widths of the tabs 48*b* and 48*c*.

As will be seen from the foregoing description of the branch joint box according to the second embodiment of the present invention, since the insertion openings extend through the base plate so as to communicate with each other the connector coupling portions formed on the opposite faces of the base plate and the bus bars are secured in the insertion openings, the casing of the branch joint box is formed by a one-piece member. Therefore, in comparison with an arrangement in which the casing of the branch joint box is formed by upper and lower casings, the branch joint box is simplified structurally. Meanwhile, since the casing of the branch joint box can be molded with resin only once by using a single die, production cost of the branch joint box can be lowered.

Meanwhile, in this branch joint box, since the bus bars are gripped between the retainer plate retained in one of the connector coupling portions and the partition wall portions of each insertion opening, the bus bars can be, respectively, secured in the insertion openings positively. At this time, since the tabs of the bus bars are inserted into the tab insertion holes or the through-holes of the retainer plate, deformation of the tabs can be prevented.

Alternatively, in the branch joint box, since the bus bars are gripped between a pair of the retainer plates, the bus bars can be fixed reliably. At this time, since the tabs of the bus bars are inserted into the through-holes of the retainer plates, deformation of the tabs can be prevented.

Furthermore, since the rib for press fitting each tab of each bus bar is provided on each insertion opening, the bus bar are secured in the insertion openings more positively.

What is claimed is:

1. A branch joint box, comprising:

a base plate; and a pair of connector coupling portions formed on opposite faces of said base plate so as to oppose each other;

said base plate having a plurality of insertion openings for inserting therethrough bus bars, each bus bar including an elongated base portion and at least one pair of tabs extending from opposite sides of said base portion;

said insertion openings extending through said base plate so that said connector coupling portions communicate with each other;

wherein said bus bars are secured in respective insertion openings, such that said tabs project into respective connector coupling portions;

at least one partition wall portion is provided at a predetermined interval in each of said insertion openings so as to divide each of said insertion openings into a plurality of tab insertion holes for inserting respective tabs therein; and a retainer plate having a plurality of through-holes for inserting respective tabs therethrough;

wherein one of said tabs is inserted through each of said through-holes such that said retainer plate is retained in one of said connector coupling portions, while the other of said tabs is inserted into each of said tab insertion holes;

wherein said bus bars are gripped between said retainer plate and said partition wall portions so as to be secured in respective insertion openings.

2. The branch joint box of claim 1, further comprising:

a rib on each insertion opening for press fitting each of said tabs into each of said insertion openings.

3. A branch joint box, comprising:

a base plate; and a pair of connector coupling portions formed on opposite faces of said base plate so as to oppose each other;

said base plate having a plurality of insertion openings for inserting therethrough bus bars, each bus bar including an elongated base portion and at least one pair of tabs extending from opposite sides of said base portion;

said insertion openings extending through said base plate so that said connector coupling portions communicate with each other;

wherein said bus bars are secured in respective insertion openings, such that said tabs project into respective connector coupling portions;

a pair of retainer plates each including a plurality of through-holes for inserting respective tabs therethrough, such that each pair of tabs are inserted through said through-holes of both plates of said pair of retainer plates;

said retainer plates being retained in respective connector coupling portions;

wherein said bus bars are gripped between said retainer plates so as to be secured in said insertion openings.

4. The branch joint box of claim 3, further comprising:

a rib on each insertion opening for press fitting each of said tabs into each of said insertion openings.

* * * * *

UNITED STATES PATENT AND TRADEMARK OFFICE

CERTIFICATE OF CORRECTION

PATENT NO. : 5,605,465

DATED : February 25, 1997

INVENTOR(S) : M. KOBAYASHI et al.

It is certified that error appears in the above-indentified patent and that said Letters Patent is hereby corrected as shown below:

Title page, item [30]

"Foreign Application Priority Data", line 2, change "Feb. 11, 1994" to ---Feb 17, 1994---.

Signed and Sealed this

Fifteenth Day of September, 1998

*Attest:*

*Attesting Officer*

Bruce Lehman

BRUCE LEHMAN

*Commissioner of Patents and Trademarks*